US006568113B1

(12) United States Patent
Valiulis

(10) Patent No.: US 6,568,113 B1
(45) Date of Patent: May 27, 2003

(54) LABEL CHANNEL WITH TOP-HINGED FRONT PANEL

(75) Inventor: Stanley C. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 09/473,661

(22) Filed: Dec. 29, 1999

(51) Int. Cl.[7] ..... G09F 3/18; G09F 3/10

(52) U.S. Cl. ..... 40/661.06; 40/661.09; 40/653

(58) Field of Search ..... 40/642.02, 653, 40/658, 647, 648, 661, 661.06, 661.09, 661.08, 661.07, 661.03

(56) References Cited

U.S. PATENT DOCUMENTS 1,600,684 A * 9/1926 McGibbon ..... 24/30.5 R
2,827,718 A * 3/1958 Howard ..... 40/661
4,127,189 A * 11/1978 Shumrak et al. ..... 206/520
4,829,691 A * 5/1989 Manjos et al. ..... 40/661
5,109,576 A * 5/1992 Teekell et al. ..... 24/30.5 R
5,392,547 A * 2/1995 Mason ..... 40/642
5,515,632 A * 5/1996 Gebka et al. ..... 40/642
6,026,603 A * 2/2000 Kump et al. ..... 40/661.03
6,035,569 A * 3/2000 Nagel et al. ..... 40/661.03
6,105,295 A * 8/2000 Brinkman et al. ..... 40/661.03
6,119,990 A * 9/2000 Kump et al. ..... 40/661.03
6,263,603 B1 * 7/2001 Wildrick ..... 40/661

* cited by examiner

*Primary Examiner*—Lynne H. Browne
*Assistant Examiner*—Kenn Thompson
(74) *Attorney, Agent, or Firm*—David I. Roche; Baker & McKenzie

(57) ABSTRACT

A label holding device with as protective front cover. A label channel for use on retail shelving typically includes opposing U-shaped formation into which a label may be inserted. To protect the label from spills and to prevent the U-shaped formations from becoming clogged with spilled material a cover panel is hingedly connected to the top part of the label channel.

5 Claims, 1 Drawing Sheet

LABEL CHANNEL WITH TOP-HINGED FRONT PANEL

BACKGROUND AND SUMMARY OF THE INVENTION

This invention relates to label holders for shelving used to display merchandise. In particular, the a label channel for displaying pricing and other information on the front face of a shelf.

It is important to clearly display pricing and other information directly adjacent to items for sale at retail. In wide use are channels which are integral with or attached to the front face of a shelving unit. The channels typically have U-shaped ends into which the edges of a replaceable paper or cardboard label may be inserted. It is not uncommon, particularly in supermarkets where a wide variety of products are sold, for spillage to occur on shelving where items are displayed. For example, liquid and powdered productss are frequently packaged such that small amounts of the packaged material escapes the package and are deposited on the horizontal surface of the shelving upon which the packages are placed for sale. As the containers are removed by purchasers, the residual spilled material which has escaped the containers migrates into the label channels on the front of the shelving.

When such material makes its way into the channels where labels are to be placed, the channel may become clogged and difficult to use. The channels must, therefore, be cleaned thoroughly and frequently. Because of the small width of the channels into which the pricing information is placed, cleaning is a difficult and tedious process. Alternatively, the label channel may be removable from, rather than integral with, the shelving and the label channel may be replaced when it becomes unusable due to clogging of the channel with spilled material. This alternative can become expensive, depending on the frequency with which the label channels are replaced.

Even if the label channel does not become clogged and unusable itself, spilled material, particularly spilled liquid products, can stain or make soggy the labels held in a label channel. This kind of situation can render a product display unsightly and unattractive to the purchaser.

Therefore, there is a need for a label channel which reduces the opportunity for spilled material to make its way into and clog a label channel. There is also a need for a label channel which protects the pricing information with a cover which provides ready access to the label channel so that pricing information may be moved to a different position or replaced. The label channel of the present invention reduces the tendency for material spilled on a shelving unit to degrade the functionality of the label channel and protects the pricing information contained in the label channel from being rendered unsightly by spilled material.

The label channel of the present invention includes a base panel with opposing upper and lower U-shaped ends. A front panel is hingedly connected to the upper U-shaped end. The front panel is shaped and sized to protect pricing information held by the U-shaped ends of the label channel. The hinge by which the front panel is connected to the upper U-shaped end tends to hold the front panel in a position generally parallel to the base panel. The invention further includes a latch on the lower end of the front panel which snaps into holding engagement with an extension of the lower U-shaped end of the label channel. The latch on the lower end of the front panel includes a larger radius J-portion with a smaller radius bead which fits into a space adjacent to the underside of the lower U-shaped end of the label channel.

The label channel of the present invention preferably includes a way of attaching the label channel to the front face of a shelving unit. One such way of attaching the label channel is through the use of a strip of double-sided adhesive with a removable cover sheet. Alternatively, the label channel may be extruded in such a way that flanges are formed which cooperate with integral formations on the front face of a shelving unit. Additional features and advantages of the invention will become apparent from a reading of the following detailed description and claims when read in conjunction with the accompanying drawings wherein:

DETAILED DESCRIPTION OF THE DRAWINGS

Figure 1:
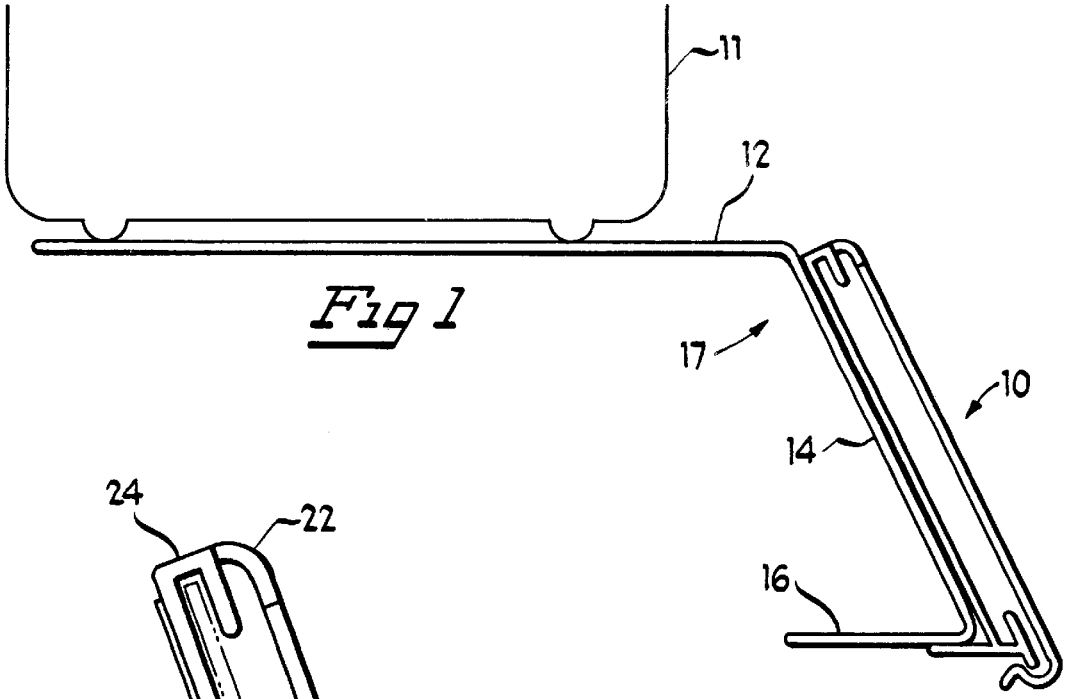
FIG. 1 is a cross-sectional view of a shelving unit with a label channel of the present invention attached to the front face thereof.

In FIG. 1, an item 11 for sale is supported upon the main horizontal surface 12 of a shelf 17. The shelf 17 includes a front face 14, which in FIG. 1 is shown as being slanted and facing somewhat upwardly. The shelf 17 further includes a lower flange 16 which is generally parallel to the main horizontal surface 12. A label channel 10 is mounted to the front face 14.

Figure 2:
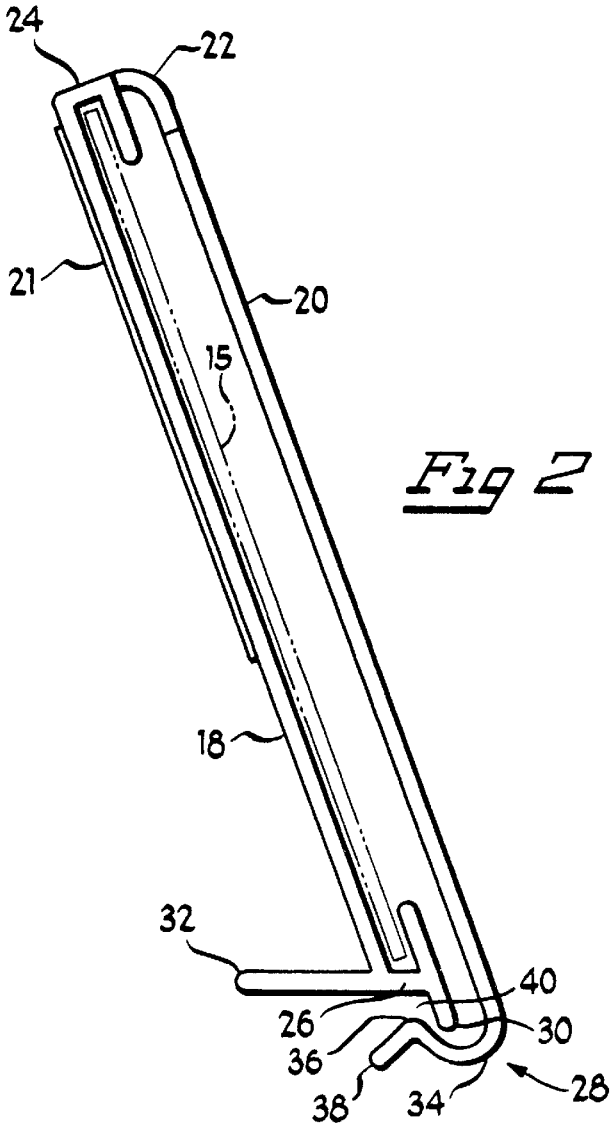
FIG. 2 is an enlarged cross-sectional view of a label channel made in accordance with the present invention.

FIG. 2 shows the label channel 10 in more detail. A base panel 18 has an upper U-shaped end 24 and a lower U-shaped end 26. The U-shaped ends 24 and 26, respectively, provide a space into which a label 15 may be inserted. A front panel 20 is attached by an integral soft and flexible hinge 22. The hinge 22 joins the front panel 20 to the upper U-shaped end 24. The front panel 20 is preferably made of a clear, transparent polyvinyl-chloride (PVC).

The soft flexible hinge 22 is preferably made of a softer plastic material such as a PCV with plasticizers. The label channel 10 shown in FIG. 2 is preferably made from a single co-extrusion process. As an alternative to a co-extrusion with two different materials, the hinge 22 may be made of the same material as the rest of the label channel, but may be made to have a thinner cross-section at the hinge location to provide the ability of the front panel 20 to be lifted upwardly to expose the space defined by the upper U-shaped end 24 and the lower U-shaped end 26.

The lower end of the front panel 20 includes a latch 28. The latch 28 includes a large J-portion 34 which receives an extension 30 extending from the lower U-shaped end 26. The latch 28 further includes a smaller radius bead 36 an d a straight portion 38 which guides the latch 28 over the extension 30 as the front panel is snapped into a latched position, as is shown in FIG. 2. The label channel 10 further includes a locating rib 32 extending in a rearward direction from the lower U-shaped end 26. The bead 36 snaps into a space 40 defined by the extension 30, the lower U-shaped end 26, and the locating rib 32. The front panel 20 and the J-portion 34 have sufficient flexibility to allow the bead 36 to snap past the extension 30 upon the application of light hand pressure.

The soft flexible hinge 22 is preferably continuous along the upper U-shaped end 24 of the label channel 10. The continuous nature of the hinge 22 and the integral connection of the front panel 20 to the flexible hinge 22 directs any spilled material around the information held by the U-shaped ends 24 and 26. Thus, any spilled material, whether liquid or solid, will travel down the front panel 20 to the J-portion 34 and will bypass the label 15.

The material used to make the front and back panels of the label channel 10 is preferably a food grade PVC (polyvinly cloride), such as one called OXYCLEAR™ food grade packaging compound sold by the Occidental Chemical Corp., and the hinged portion connecting the front and back panels is preferably also a PVC, but one having low hardness and high elongation. It is important that the font panel be a clear material so that labels held in the channel may be readily seen. The base panel may be opaque or clear, although opaque provides the advantage of concealing the front face of the shelving to which the channel is affixed and the double-sided adhesive used to attach the channel to the shelving. A suitable hinge material is an extrudable PVC having a Shore A hardness (10 seconds) of between 60 and 95, and an elongation of between 435% and 270%, such as the vinyl compounds sold by Sulvin Technologies, Inc. under the trade mark SYLVIN 8852™ Series compounds. These two PVC materials, a more rigid one for the front and back panel and a softer one for the hinge, when both are cooled, are preferably used in a coextrusion process to produce the label channel of the present invention. Alternatively, an extrudable butyrate material may be used for the front and base panels with a soft PVC hinge therebetween.

The label channel 10 shown in FIGS. 1 and 2 is also equipped with a strip of double-sided adhesive 21 which includes a cover sheet (not shown) which exposes the adhesive when the cover sheet is removed just prior to placement of the label channel 10 into position on the front face 14 of a shelf 17. The locating rib 32 is shaped to abut the lower flange 16 of a shelf 17. The double-sided adhesive 21 is one means by which the label channel 10 may be affixed to a shelf 17. Alternatively, the extrusion which comprises the label channel 10 may be formed with flange elements which engage a shelving unit which has an integral channel formed therein. For example, small extensions extending rearwardly from the base panel 18 may be formed so as to engage upper and lower channels in an integral channel of a shelf. This method of attachment is common and can be found in the prior art, for example, in U.S. Pat. No. 5,096,647; U.S. Pat. No. 5,488,793; and U.S. Pat. No. 5,899,011.

While the invention has been described with reference to a particular embodiment which has been shown in the figures and discussed above, it will be apparent to those skilled in the art that numerous variations, modifications and improvements may be made to the invention described herein without departing from the spirit and scope of the invention as defined by the appended claims.

What is claimed is:

1. A label channel for store shelving comprising an elongated channel for displaying a label on a forward-facing edge of a store shelf, a main channel formed by a base panel and opposing upper and lower U-shaped ends, a front panel extending from said upper U-shaped end, said front panel being connected to said upper U-shaped end by a soft, flexible hinge, said hinge tending to bring said front panel to a position generally parallel to said base panel, said front panel has a lower edge carrying a latch shaped to latchingly engage an extension of said lower U-shaped end, a locating rib extends rearwardly from said lower U-shaped end disposed beneath an adhesive strip extending along a rear face of said base panel, said strip having a removable and disposable cover, said rib providing a guide for aligning said channel during application of said channel using said adhesive strip to attach said channel to a forward-facing shelf edge.

2. A label channel in accordance with claim 1 wherein:

said lower edge of said front panel has a bead with a beveled surface capable of snapping engagement with said extension of said lower U-shaped end.

3. A label channel in accordance with claim 1 wherein:

said label channel is an extrusion comprised of at least two materials, a first material comprising said soft, flexible hinge, and a second material comprising said base panel and said U-shaped ends.

4. A label channel in accordance with claim 3 wherein:

said first material is a low hardness and high elongation PVC, and said second material is a rigid PVC.

5. A label channel in accordance with claim 1 wherein:

said channel is formed as a three-component coextrusion with a first material comprising said hinge, a second material comprising said base panel and a third material comprising said front panel, said first, second and third materials being PVC, at least said third material being clear, said second and third materials, when cooled to room temperature, being substantially more rigid than said first material.

* * * * *